US009325090B2

(12) United States Patent
Shen et al.

(10) Patent No.: US 9,325,090 B2
(45) Date of Patent: Apr. 26, 2016

(54) CARD EDGE CONNECTOR WITH A METAL MEMBER

(71) Applicant: HON HAI PRECISION INDUSTRY CO., LTD., New Taipei (TW)

(72) Inventors: Xue-Hai Shen, Kunshan (CN); Zhuang-Xing Li, Kunshan (CN); Wen-Jun Tang, Kunshan (CN); Xue-Wu Bu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 27 days.

(21) Appl. No.: 14/105,200

(22) Filed: Dec. 13, 2013

(65) Prior Publication Data

US 2014/0170875 A1 Jun. 19, 2014

(30) Foreign Application Priority Data

Dec. 13, 2012 (CN) ..... 2012 2 0687191 U

(51) Int. Cl.

| | |
|---|---|
| ***H01R 13/62*** | (2006.01) |
| ***H01R 12/70*** | (2011.01) |
| ***H01R 12/72*** | (2011.01) |
| ***H01R 12/73*** | (2011.01) |

(52) U.S. Cl.

CPC ..... *H01R 12/7005* (2013.01); *H01R 12/721* (2013.01); *H01R 12/737* (2013.01)

(58) Field of Classification Search

CPC ..... H01R 12/83

USPC ..... 439/152, 153, 159, 160, 267, 326, 630, 439/949, 157, 372

See application file for complete search history.

(56) References Cited

U.S. PATENT DOCUMENTS

| | | | | |
|---|---|---|---|---|
| 4,341,428 | A * | 7/1982 | Hatch et al. | 439/372 |
| 4,843,190 | A * | 6/1989 | Verhoeven | 174/261 |
| 5,383,792 | A * | 1/1995 | Korsunsky et al. | 439/326 |
| 6,162,069 | A * | 12/2000 | Choy | 439/92 |
| 8,052,448 | B2 * | 11/2011 | McKee | 439/326 |
| 8,753,138 | B2 * | 6/2014 | Foster et al. | 439/326 |

* cited by examiner

*Primary Examiner* — Felix O Figueroa
*Assistant Examiner* — Paul Baillargeon
(74) *Attorney, Agent, or Firm* — Wei Te Chung; Ming Chieh Chang

(57) ABSTRACT

A card edge connector includes an insulative housing, a number of contacts retained in the insulative housing and an ejector retained the insulative housing to lock an electronic card. The insulative housing includes a central slot for receiving the electronic card and two end portions located on opposite sides of the central slot respectively. The card edge connector also includes a metal member located on the end portion of the insulative for electrically connecting to the metal member. Thus, The card edge connector having a higher electrical function.

2 Claims, 6 Drawing Sheets

CARD EDGE CONNECTOR WITH A METAL MEMBER

BACKGROUND OF THE INVENTION

1. Field of the Invention

The present invention generally relates to a card edge connector and more particularly to a card edge connector with a lock mechanism.

2. Description of Related Art

U.S. Pat. No. 7,922,506, issued on Apr. 12, 2011, discloses a related card edge connector which includes an elongated insulative housing, a plurality of terminals retained in the housing and a pair of lock mechanisms pivoted on two opposited ends of the housing. However, said card edge connector does not have a high power electrical function.

Hence, an improved card edge connector is desired to overcome the above problems.

SUMMARY OF THE INVENTION

Accordingly, an object of the present invention is to provide a card edge connector having a higher electrical function.

To achieve the above object, a card edge connector comprising an elongated insulative housing and a plurality of terminals retained in the housing. The elongated insulative housing having a central slot for insertion of a daughter card and a pair of end portions located on opposite sides of the central slot respectively. Said terminals protruding into the central slot for mating with the daughter card and at least one lock mechanism pivoted on the end portion for locking with the daughter card. The card edge connector further comprises a metal member located on the end portion of the insulative for electrically connecting to the daughter card.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
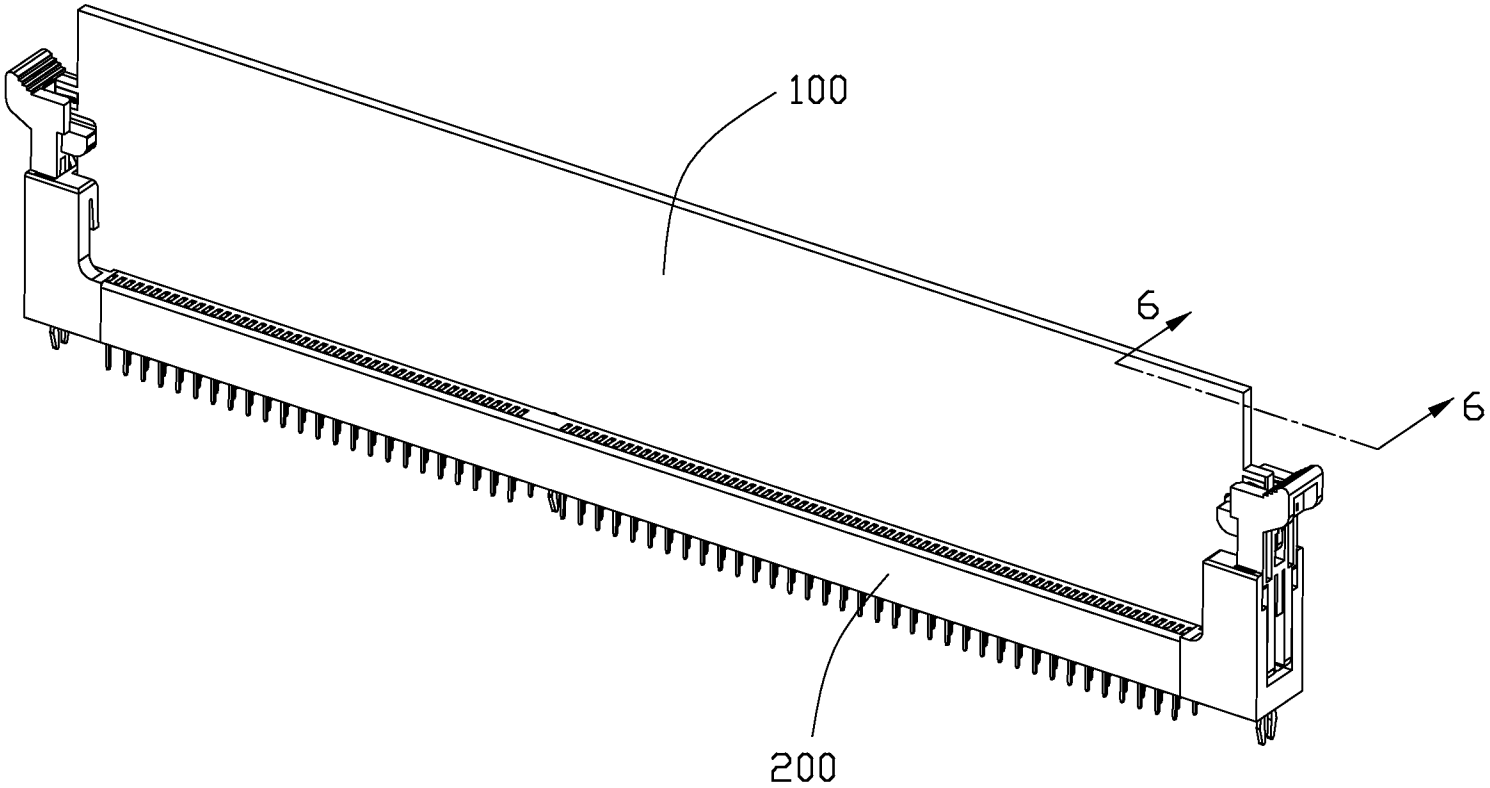
FIG. 1 is an assembled, perspective view of a card edge connector and a daughter card inserted into the card edge connector.

Reference will be made to the drawing figures to describe the present invention in detail, wherein depicted elements are not easily shown to scale and wherein like or similar elements are designated by same or similar reference numeral through the several views and same or similar terminology.

Figure 2:
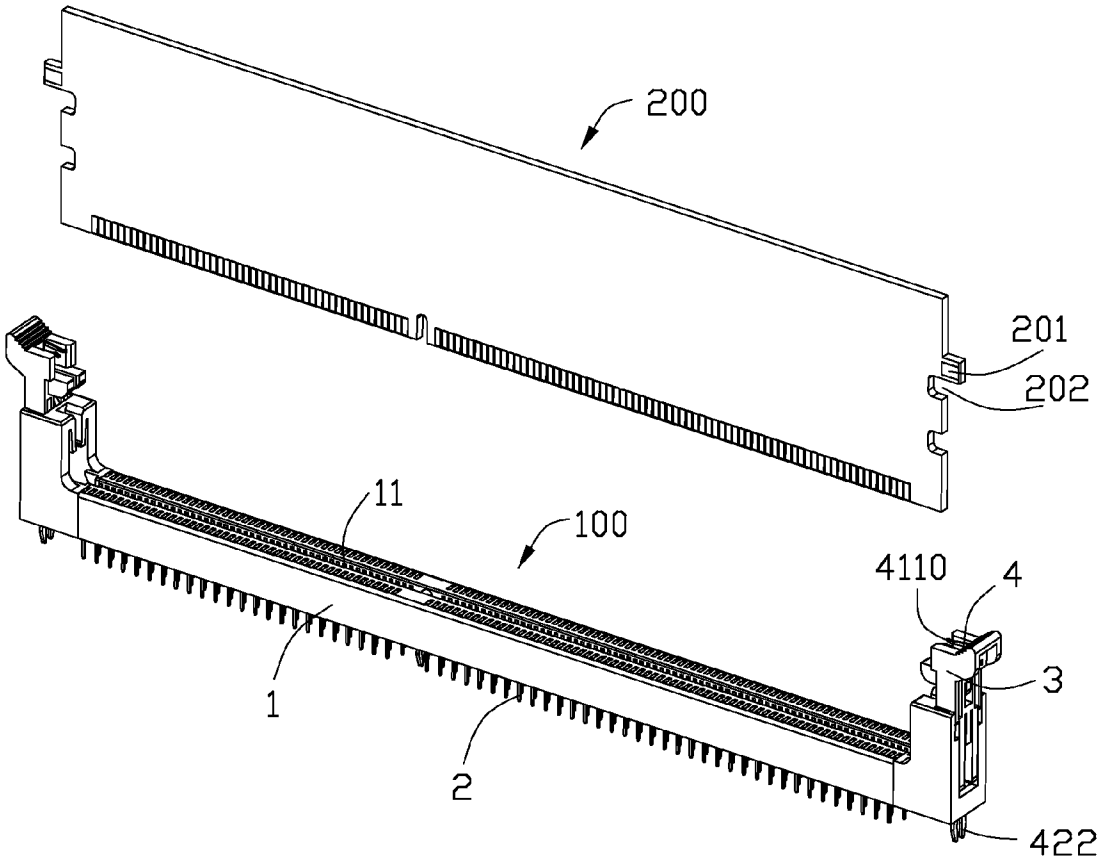
FIG. 2 is an assembled, perspective view of a card edge connector and a daughter card pulled out of the card edge connector.
Figure 3:
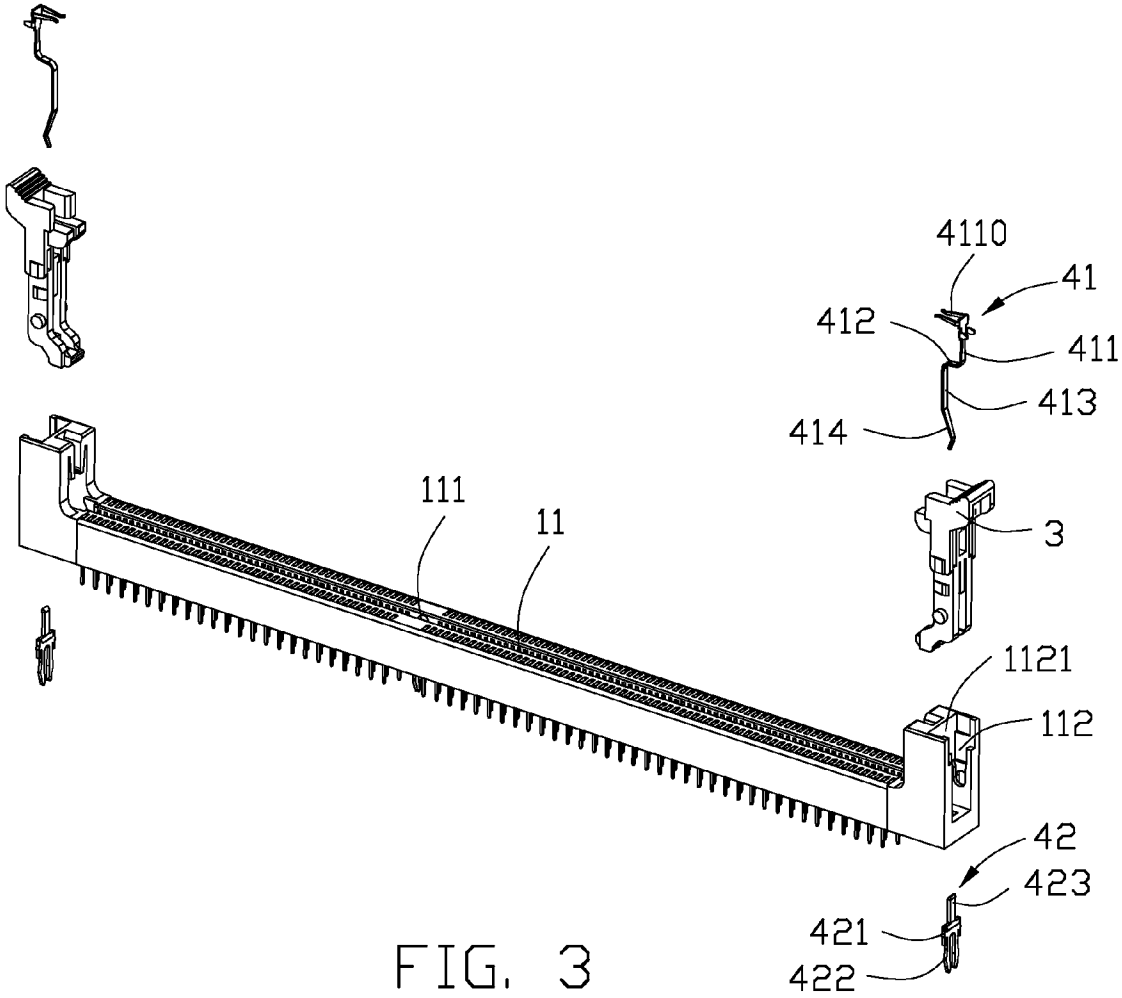
FIG. 3 is an explored, perspective view of the card edge connector according to a preferred embodiment of the present invention.

Referring to FIGS. 1 to 3, a card edge connector 100 comprises an elongated insulative housing 1, a plurality of terminals 2 retained in the housing 1, at least one lock mechanism pivoted on an end portion of the housing 1 for locking with the daughter card 200. Said card edge connector further comprises a metal member 4 locating on the end portion for electrically connecting to the daughter card 200.

Referring to FIG. 3, the elongated insulative housing 1 has a central slot 11 for insertion of the daughter 200 and said end portions are located on opposite sides of the central slot 11 in a longitudinal direction, said terminals 2 are protruding into the central slot 11 for mating with the daughter card 200. A key 111 is formed in the central slot 11 to divide the central slot 11 into two different parts with different lengths so as to prevent the daughter card 200 from mismating. A receiving room 112 is formed on a top surface of end portion for receiving the lock mechanism 3, said receiving room 112 defines a retaining wall 1121 for the lock mechanism abutting against, the metal member 14 is clamped between said lock mechanism 3 and retaining wall 1121 when the daughter card 200 is inserted into the central slot 11.

Said metal member 4 can provide a high power electrical function between the card edge connector 100 and the daughter card 200. Referring to FIG. 2, the metal member 4 defines a pair contacting arms 4110 for electrically connecting to the daughter card 200 and a mounting portion 422 for mounting on a printed circuit board (not shown), said daughter card 200 defines a pair of gold-fingers 201 on opposite sides in a lengthwise direction, the contacting arms 4110 connect to the gold-fingers 201 and the mounting portion 422 respectively.

Referring to FIG. 3, said metal member 4 includes a contacting member 41 and a mounting member 42, one side of the contacting member 41 connects to the gold-finger 201 of the daughter card 200 and another side connects to the mounting member 41, said mounting member 41 is mounted on the printed circuit board (not shown), the lock mechanism 3 can control the on-off between the contacting member 41 and the mounting member 42 via rotating the lock mechanism, thus, said card edge connector has a good grounding characteristics when the lock mechanism 3 is opened.

Figure 4:
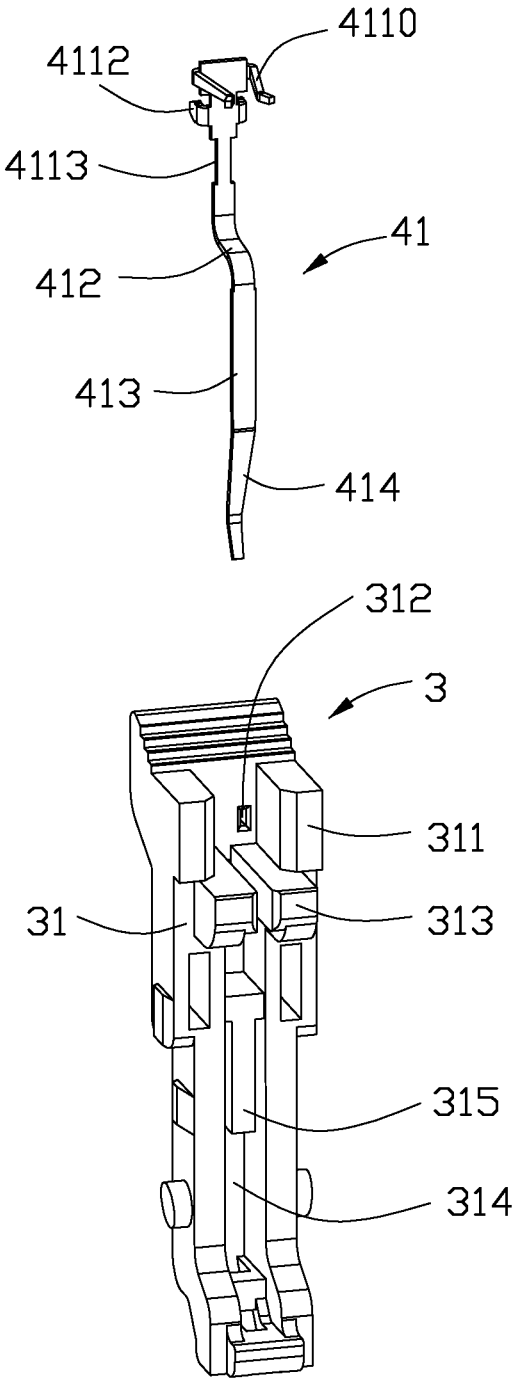
FIG. 4 is an explored, perspective view of the metal member separated from the lock mechanism.
Figure 5:
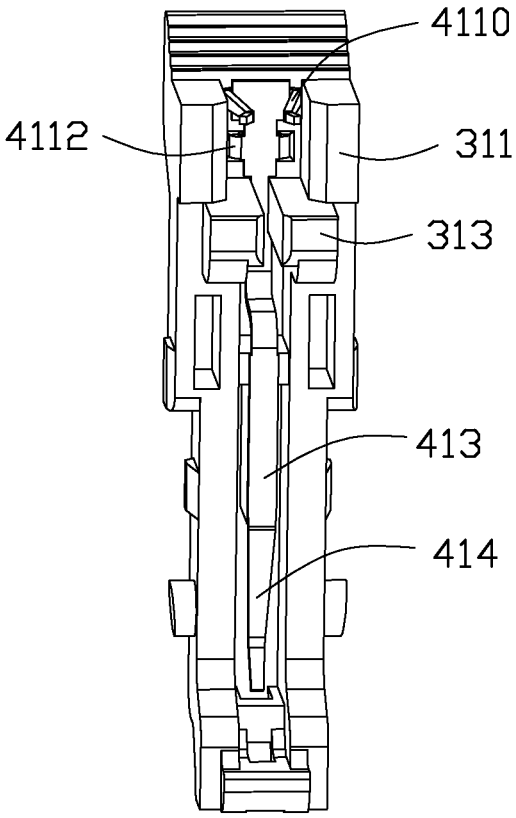
FIG. 5 is an explored, perspective view of the metal member inserted into of the lock mechanism.

Referring to FIGS. 3 to 5, said contacting member 41 defines a body section 411, a horizontal section 412 perpendicular to the body section 411, a clamping section 413 perpendicular to the horizontal section 412 which extends on a reverse direction of the body section 411 and an elastic section 414 obliquely bending towards to a same side of the body section 411. Said clamping section 413 is clamped between said lock mechanism 3 and retaining wall 1121, the elastic section 414 abuts against an upper side of the mounting member 42.

The lock mechanism 3 defines an internal surface 31 faced to the retaining wall 1121, a pair of protecting wall 311 formed on opposite sides of the internal surface 31, said protecting walls 311 are located on outer sides of the contacting arms 4110 respectively for protecting said contacting arms 4110 from overdeformation.

Said internal surface 31 defines a pair of holes 312 located between two protecting walls 4110, a pair of locking portions 313 are symmetrically formed on the internal surface 31 and are located under said holes 312. The body section 411 defines a pair of retaining arms 4112 extended towards to the internal surface 31 and said retaining arms 4112 are retained in the holes 312, the body section 411 further defines a pair of openings 4113 located under retaining arms 4112, said contacting member 41 has a reliable positioning in a height direction via the openings 4113 retained between two locking portions 313. The internal surface 31 forms a vertical grooves 314 at a center thereof. An abutting portion 315 is formed in the vertical groove 314, said abutting portion 315 is located under the locking portion 313, said contacting member 41 also has a reliable positioning in the lengthwise direction via the clamping section 413 retained between the abutting portion 315 and the retaining wall 1121.

Figure 6:
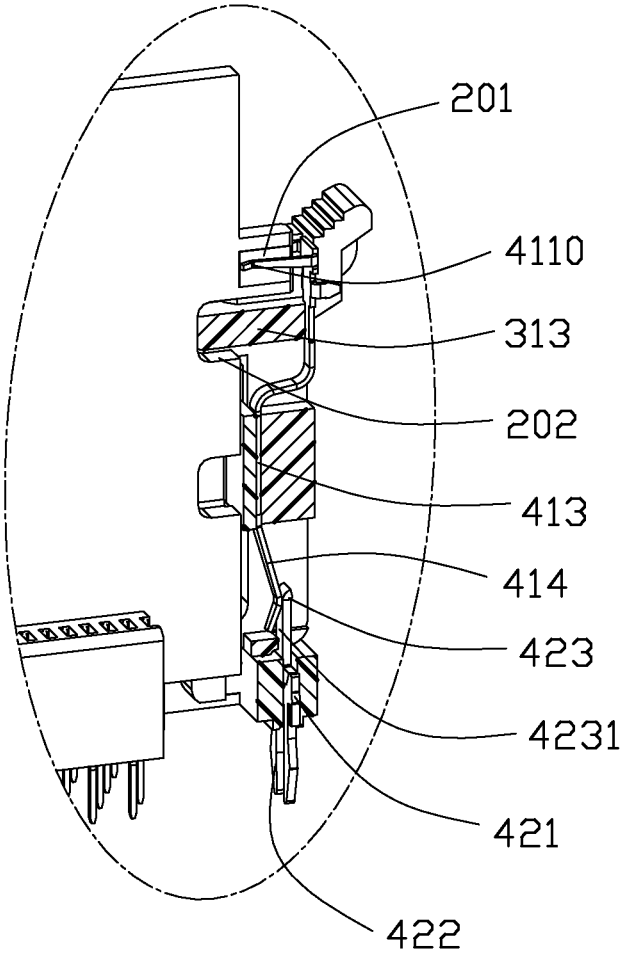
FIG. 6 is a cross section view of the card edge connector taken along a broken line 6-6 in FIG. 1.

Referring to FIG. 6, said mounting member 41 defines a locking section 421 which is retained in the insulative housing 1, a mounting section 422 which is mounted on the printed circuit board (not shown) and a abutting section 423 which extends into the receiving room 112. Said abutting section 423 defines an inner face 4231 which faces to the retaining wall 1121 for connecting the contacting member 41 via the elastic section 414 abutting against the inner face 4231.

When the daughter card 200 is not inserted into the card edge connector 100, said contacting member 41 does not connect with the mounting member 42, and conversely, when the daughter card 200 is inserted into the card edge connector 100, said contacting arms 4110 connect with the gold-fingers 201 and said elastic section 414 connect with the abutting section 423 so as to transmit high power electrical. Thus, said card edge connector has a high power electrical function.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated insulative housing having an central slot for insertion of a daughter card and a pair of end portions located on opposite sides of the central slot respectively;

a plurality of terminals retained in the housing and protruding into the central slot for mating with the daughter card; and at least one lock mechanism pivoted at one end portion for locking with the daughter card; wherein the card edge connector further comprise a metal member located on the end portion of the insulative housing for electrically connecting to the daughter card; wherein the metal member defines a contacting arm for electrically connecting to the daughter card and a mounting portion adapted to be mounted on a printed circuit board; wherein the metal member includes a contacting member and a mounting member, one side of the contacting member connects to the daughter card and another side connects to the mounting member, and said mounting member is mounted on the printed circuit board and retained in the end portion; wherein a receiving room is formed on a top region of the end portion to receive the lock mechanism, the housing defines a retaining wall around the receiving room for abutting against the lock mechanism, and the contacting member is associatively moveable with the lock mechanism and clamped between said lock mechanism and said retaining wall in a longitudinal direction along which said central slot extends; wherein said contacting member defines a body section, a horizontal section perpendicular to the to the body section, a clamping section perpendicular to the horizontal section which extends on a reverse direction of the body section and an elastic section obliquely bending towards a same side of the body section, the clamping section is clamped between said lock mechanism and said retaining wall, said elastic section abuts against on a upper side of the mounting member; wherein the lock mechanism defines an internal surface faced to the retaining wall, a pair of protecting walls are formed on opposite sides of the internal surface, said protecting walls are located on outer sides of the contacting arms respectively; wherein said internal surface defines a pair of holes located between said two protecting walls, a pair of locking portions are symmetrically formed on the internal surface and located under said holes, said body section defines a pair of retaining arms extending towards to the internal surface and said retaining arm is retained in the hole, said body section defines a pair of openings located under retaining arms, said openings are retained between two locking portions, a vertical groove is formed at a central of the internal surface and an abutting portion is formed in the vertical groove, said abutting portion is located under the locking portion, the clamping section is retained between the abutting portion and the retaining wall.

2. The card edge connector as claimed in claim 1, wherein said retaining arm is located under the contacting section.

* * * * *